US008207807B2

(12) United States Patent
Kikuchi et al.

(10) Patent No.: US 8,207,807 B2
(45) Date of Patent: Jun. 26, 2012

(54) COIL

(75) Inventors: Shuichi Kikuchi, Tokyo (JP); Morihiro Kuroda, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 13/032,966

(22) Filed: Feb. 23, 2011

(65) Prior Publication Data

US 2012/0025940 A1 Feb. 2, 2012

(30) Foreign Application Priority Data

Jul. 30, 2010 (JP) ..... 2010-172477

(51) Int. Cl.
*H01F 27/28* (2006.01)
*H01F 5/00* (2006.01)

(52) U.S. Cl. ..... 336/188; 336/200; 336/189

(58) Field of Classification Search ..... 336/200, 336/223, 232, 188–189, 182–183
See application file for complete search history.

(56) References Cited

U.S. PATENT DOCUMENTS

2008/0272875 A1* 11/2008 Huang et al. ..... 336/182
2008/0297295 A1* 12/2008 Yamazaki et al. ..... 336/90
2009/0121819 A1* 5/2009 Haratani et al. ..... 336/221
2010/0277004 A1* 11/2010 Suzuki et al. ..... 307/104

FOREIGN PATENT DOCUMENTS

JP 04122007 A * 4/1992
JP A-2005-006440 1/2005
JP A-2008-172872 7/2008
JP B2-4321054 8/2009

* cited by examiner

*Primary Examiner* — Anh Mai

(74) *Attorney, Agent, or Firm* — Oliff & Berridge, PLC

(57) ABSTRACT

A coil is formed by coaxially winding a second winding so as to be in intimate contact with an outer circumferential portion of a first winding wound about a winding shaft axis. In the first winding, one side of a winding wire is wound from an inner circumferential side to an outer circumferential side, the other side of the winding wire is drawn forth from the inner circumferential side to the outer circumferential side, while crossing the one side of the winding wire, and a thickness in a direction of the winding shaft axis in crossing portions of the one side of the winding wire and the other side of the winding wire is equal to a thickness in other portions.

9 Claims, 10 Drawing Sheets

COIL

RELATED APPLICATIONS

This application claims the priority of Japanese Patent Application No. 2010-172477 filed on Jul. 30, 2010 which is incorporated herein by reference.

BACKGROUND OF THE INVENTION

1. Field of the Invention

The present invention relates to a coil to be used suitable as an inductor or transformer for various electric devices, and more particularly to a thin-type coil advantageously suitable for contactless power transmission (contact-free power transmission).

2. Description of the Related Art

The technology of contactless power transmission designed so that power exchange is performed in a contactless (contact-free) manner by electromagnetic coupling of a coil in a transmitter and a coil in a receiver has found use in cellular phones, portable information terminal devices, and home electric devices (see Japanese Laid-Open Patent Publication No. 2008-172872 and Japanese Laid-Open Patent Publication No. 2005-6440 below).

In a large number of electric devices using such contactless power transmission, miniaturization and thickness reduction are strongly required for devices on both the transmission side and the reception side, and thin-type air-core coils that can easy fulfill such requirements are often used in the coils employed in the devices. Further, since the terminals connected to the end portions of the coil are typically disposed on the outer circumferential portion of the coil, both the one side and the other side of the winding wire of the coil should be together drawn forth to the outer circumferential side of the coil.

A method by which the other side of the winding wire is spirally wound from the inner circumferential side towards the outer circumferential side, while leaving the one side of the winding wire on the inner circumferential side, and then, after the winding is completed, drawing forth the one side of the winding wire from the inner circumferential side towards the outer circumferential side by dragging the one side of the winding wire over the coil flat surface (referred to hereinbelow as the "usual winding method") is generally known as a coil winding method. When the usual winding method is used, the winding wire should be bent when one side of the winding wire is drawn forth from the inner circumferential side onto the coil flat surface. Therefore, extra force can be easily applied to the winding (in particular, in the case of a single wire winding of a large diameter), and the drawing line portion of the winding increases in thickness by the winding wire diameter (see Japanese Laid-Open Patent Publication No. 2008-172872, FIGS. 27 and 28).

A winding method (referred to hereinbelow as "α winding method") in which a winding shaft is set close to the center at both ends of the winding and the one side and the other side of the winding wire of the coil are spirally wound in mutually opposite directions is also known as described in Japanese Patent No. 4321054 below. With the α winding method, the one side and the other side of the winding wire can be drawn forth to the outer circumferential side, without applying an unnecessary force to the winding.

In a contactless power transmission system, when the coil diameter of the transmitter and the coil diameter of the receiver are equal to one another, electromagnetic coupling between the coils is good and therefore power can be transmitted with good efficiency. In the typical conventional contactless power transmission system, only one coil having a diameter equal to the coil diameter of the receiver is provided in the transmitter. Therefore, efficient power transmission is difficult to realize with respect to a receiver having a coil of a different diameter.

To resolve this problem, in the contactless power transmission system described in Japanese Laid-Open Patent Publication No. 2005-6440, it is suggested to provide a plurality of coils arranged side by side inside a transmitter (charger) to adapt to receivers (cellular phones) of a plurality of types that differ in specifications. Where the diameters of the plurality of coils in the transmitter are made to differ from one another, it is easy to transmit power with good efficiency to receivers of a plurality of types that differ from one another in a coil diameter. However, the problem is that since a space should be ensured to accommodate a plurality of coils side by side, the transmitter is increased in size.

In order to reduce the space for accommodating the plurality of coils, it is possible to consider a configuration in which a large-diameter coil and a small-diameter coil are piled up on the same shaft, and the usage mode is switched between the large-diameter coil and small-diameter coil correspondingly to the coil diameter of the other device. With such a configuration, the space in the coil diameter direction can be reduced by comparison with the case in which the large-diameter coil and small-diameter coil are arranged side by side on the same plane. However, the problem is that because the coils should be piled up on the same shaft, a larger space is required in the direction of the winding shaft axis (height direction).

Accordingly, it would be convenient to have a coil such that makes it possible to change the diameter of the region that is used as a coil correspondingly to the size of the coil of the other device. For example, a configuration can be considered in which a winding wire wound to a small diameter is disposed inside (inner diameter portion) of an annularly wound winding wire and the configuration can be switched between a mode in which only the small-diameter winding is used as a coil and a mode in which the small-diameter winding and the annular winding are used together as one large-diameter coil correspondingly to the coil diameter in the other device. With such a configuration the thickness of one coil in the direction of the winding shaft axis can be decreased, while adapting to the difference in coil size in the other device. However, the problem is that because a space should be provided between the annular winding and the small-diameter winding in order to combine the two windings together, the diametrical size of one coil should be rather increased.

SUMMARY OF THE INVENTION

The present invention was created to resolve these problems and it is an object of the present invention to provide a coil such that the diameter of the region used as a coil can be changed and the thickness in the direction of the winding shaft axis and the size in the diametrical direction can be reduced.

The coil in accordance with the present invention has the following feature to attain the abovementioned object.

Thus, the present invention provides a coil including: a first winding which is composed of a single wire or a plurality of wires, and is wound about a winding shaft axis; and a second winding which is composed of a single wire or a plurality of wires, and which is wound coaxially with the first winding so as to be in intimate contact with an outer circumferential portion of the first winding, wherein at least in the first winding among the first winding and the second winding, one side of a winding wire is wound from an inner circumferential side to an outer circumferential side, the other side of the winding wire is drawn forth from the inner circumferential side to the outer circumferential side, while crossing the one side of the winding wire, and a thickness in crossing portions of the one side of the winding wire and the other side of the winding wire in a direction of the winding shaft axis is equal to a thickness in other portions.

In the coil in accordance with the present invention, it is preferred that the other side of the winding wire is drawn forth to the outer circumferential side so as to form a spiral curve so that the crossing portions of the one side of the winding wire and the other side of the winding wire shift in a circumferential direction towards the outer circumferential side.

Further, the one side of the winding wire and the other side of the winding wire in the first winding are drawn forth to the outer circumferential side of the second winding so as to form respective spiral curves, while crossing the second winding, and in the second winding, a thickness in a direction of the winding shaft axis in each of the crossing portions of the one side of the winding wire in the first winding, the other side of the winding wire in the first winding, and the second winding is equal to a thickness in other portions.

Still further, the other side of the winding wire in the first winding is wound in a state in which two wires are arranged side by side in a diametrical direction, while at portions where the one side of the winding wire and the other side of the winding wire do not cross, the one side of the winding wire in the first winding is wound in a state in which the two wires are piled up in the direction of the winding shaft axis, and at portions where the one side of the winding wire and the other side of the winding wire cross, the one side of the winding wire in the first winding is wound in a state in which the two wires are arranged side by side in the diametrical direction.

In addition, the coil may be useful for contactless power transmission.

Further, in the coil according to the present invention, at least either one of the first winding and the second winding is composed of a plurality of wires and is also composed of a self-fusing wire.

It is preferable to compose the coil as an air-core coil.

Further, an outer contour shape and a shape of each corner of an air-core portion of an air-core coil are rounded rectangular shapes, or an outer contour shape and a shape of an air-core portion of an air-core coil are elliptical shapes.

Further, in accordance with the present invention, it is preferred that when the other side of the winding wire is drawn forth from the inner circumferential side to the outer circumferential side, while crossing the one side of the winding wire, the other side of the winding wire be drawn forth from the inner circumferential side to the outer circumferential side, while being wound in the direction opposite to the one side of the winding wire.

Since the coil in accordance with the present invention includes a first winding wound about a winding shaft axis and a second winding wound coaxially on the outer circumferential portion of the first winding, it is possible to switch between a mode in which only the first winding is used as a small-diameter coil and a mode in which the first winding and the second winding are used together as one large-diameter coil, that is, to change the diameter of the region used as a coil. Furthermore, since the second winding is wound so as to be in intimate contact with the outer circumferential side of the first winding, no unnecessary space appears between the first winding and the second winding, and therefore, the size in the diametrical direction of one coil can be reduced.

Further, at least in the first winding among the two windings, one side of the winding wire is wound from the inner circumferential side to the outer circumferential side, the other side of the winding wire is drawn forth from the inner circumferential side to the outer circumferential side, while crossing the one side of the winding wire, and the thickness in the crossing portions of the one side of the winding wire and the other side of the winding wire in the direction of the winding shaft axis is equal to the thickness in other portions. Therefore, at least in the winding region of the first winding, the thickness of the drawing line portion of the other side of the winding wire does not become larger than the thickness of other portions and therefore uniformity of thickness in the direction of the winding shaft axis can be achieved and thickness can be reduced.

Further, if a configuration is used in which in both the first winding and the second winding, the one side of the winding wire is wound from the inner circumferential side to the outer circumferential side, the other side of the winding wire is drawn forth from the inner circumferential side to the outer circumferential side, while crossing the one side of the winding wire, and the thickness in the direction of the winding shaft axis in the crossing portions of the one side of the winding wire and the other side of the winding wire is equal to the thickness in other portions, and additionally the one side of the winding wire and the other side of the winding wire in the first winding are drawn from to the outer circumferential side of the second winding, while crossing the second winding so as to form respective spiral curves, and the second winding is configured such that the thickness in the direction of the winding shaft axis in each of the crossing portions of the one side of the winding wire and the other side of the winding wire in the first winding, and the second winding is equal to the thickness in other portions, then the thickness of the drawing line portion obtained when the one side of the winding wire and the other side of the winding wire in the first winding are drawn forth to the outer circumferential side of the second winding and the thickness of the drawing line portion obtained when the one side of the winding wire and the other side of the winding wire in the second winding are drawn forth to the outer circumferential side of the second winding are not larger than the thickness of other portions. Therefore, the uniformity of thickness in the direction of the winding shaft axis can be achieved and thickness can be reduced not only in the winding region of the first winding, but also in the winding region of the second winding.

BRIEF DESCRIPTION OF THE DRAWINGS

FIG. 4 is a schematic view illustrating a wound state of the winding wires.

FIG. 5 is a schematic view illustrating in greater details a wound state of the winding wires.

DESCRIPTION OF THE PREFERRED EMBODIMENT

The embodiment of the coil in accordance with the present invention will be explained below in greater details with reference to the abovementioned drawings.

⟨First Embodiment⟩

Figure 1:
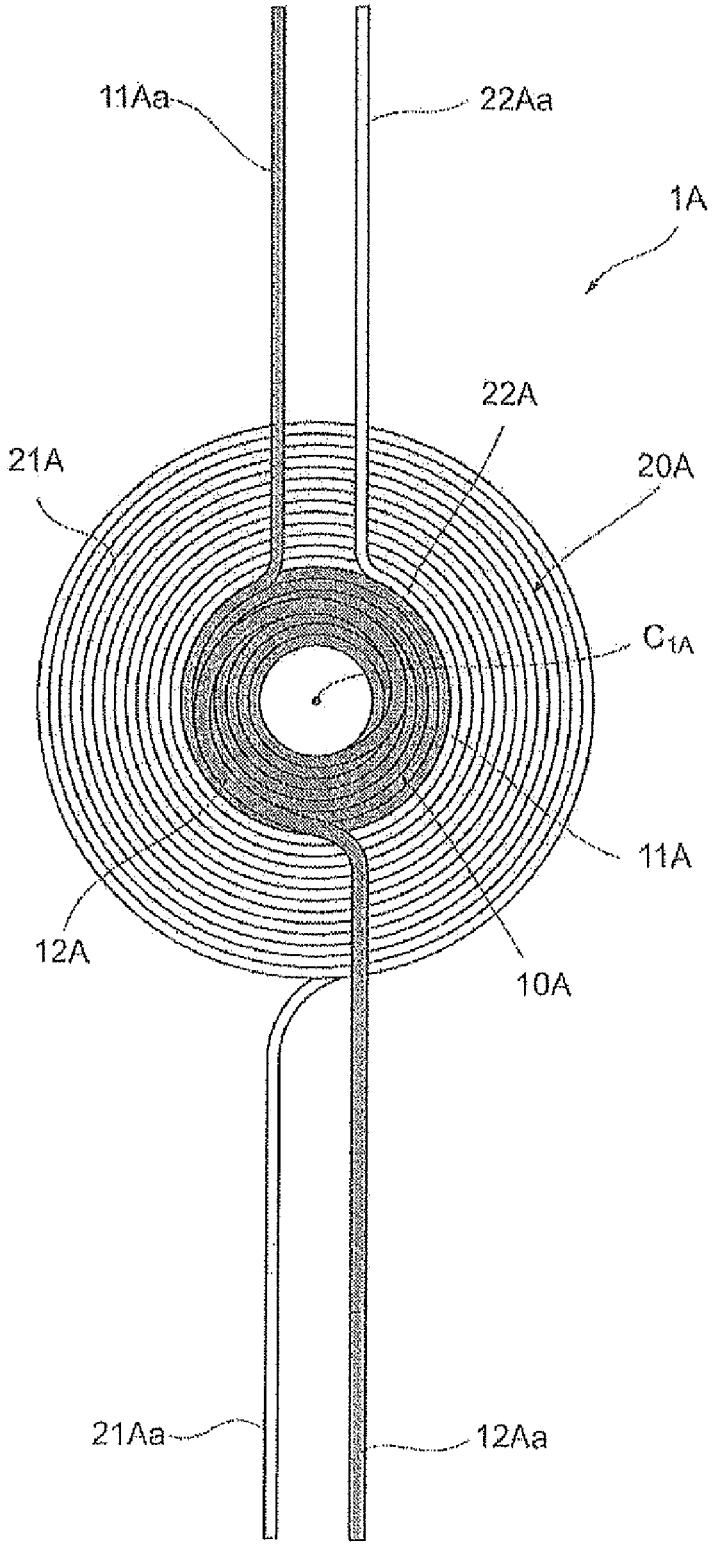
FIG. 1 is a schematic view illustrating the configuration of the coil according to the first embodiment.

A coil 1A according to the first embodiment shown in FIG. 1 is a thin-type air-core coil (the air-core portion is round) that can be advantageously used for contactless power transmission. The coil includes a first winding 10A (in the present embodiment, this winding is constituted by a plurality of wires) wound about a winding shaft axis $C_{1A}$ (virtual line perpendicular to the sheet surface) and a second winding 20A (in the present embodiment, this winding is constituted by a plurality of wires) wound coaxially with the first winding 10A so as to be in intimate contact with the outer circumferential portion of the first winding 10A.

In the first winding 10A and the second winding 20A, each wire of the plurality of wires constituting the windings is the so-called self-fusing wire (for example, a polyurethane-coated copper wire covered on the outer side with a thermoplastic fusible varnish or the like). At the stage of winding with a winding machine (not shown in the figures), the wires are maintained in a state in which they can be separated from one another and the wires are integrally fused and fixed by heating after the winding is completed (the same process is used in the below-described second and third embodiments).

In the first winding 10A, one side 11A of the winding wire is tightly wound in the clockwise direction (as shown in the figure) from the inner circumferential side to the outer circumferential side of the first winding 10A, and the other side 12A of the winding 10A is drawn forth from the inner circumferential side to the outer circumferential side of the first winding 10A, while being wound (approximately one turn) so as to form a smooth spiral curve in the counterclockwise direction, as shown in the FIG. 1, while crossing the one side 11A of the winding 10A. An end portion 11Aa of the one side 11A of the winding 10A and an end portion 12Aa of the other side 12A of the winding 10A are drawn forth from the outer circumferential side of the first winding 10A to the outer circumferential side of the second winding 20A (the end portion 11Aa is drawn upward as shown in the figure, and the end portion 12Aa is drawn downward as shown in the FIG. 1) by dragging over the second winding 20A in the diametrical direction. Further, the first winding 10A is constituted such that the thickness of the crossing portions of the one side 11A of the winding 10A and the other side 12A of the winding 10A in the direction of the winding shaft axis $C_{1A}$ is equal to the thickness of other portions (such a wound state like a rough whorl will be referred to hereinbelow as "naruto spiral winding". The naruto spiral winding will be described below in greater details).

The second winding 20A is wound by the usual winding method. Thus, one side 21A of the winding wire is tightly wound in the clockwise direction, as shown in the FIG. 1, from the inner circumferential side to the outer circumferential side of the second winding 20A (from the outer circumferential side of the first winding 10A to the outer circumferential side of the second winding 20A), and then an end portion 21Aa of the one side 21A of the winding wire is pulled out downward, as shown in the FIG. 1, from the outer circumferential side of the second winding 20A. Further, the other side 22A of the winding wire is wound through about ¼ of a turn in the counterclockwise direction, as shown in the FIG. 1, on the inner circumferential side of the second winding 20A and then drawn forth from the inner circumferential side of the second winding 20A to the outer circumferential side of the second winding 20A by dragging over the end surface of the second winding 20A in the diametrical direction. The end portion 22Aa is then pulled out upward as shown in the FIG. 1.

Figure 4A:
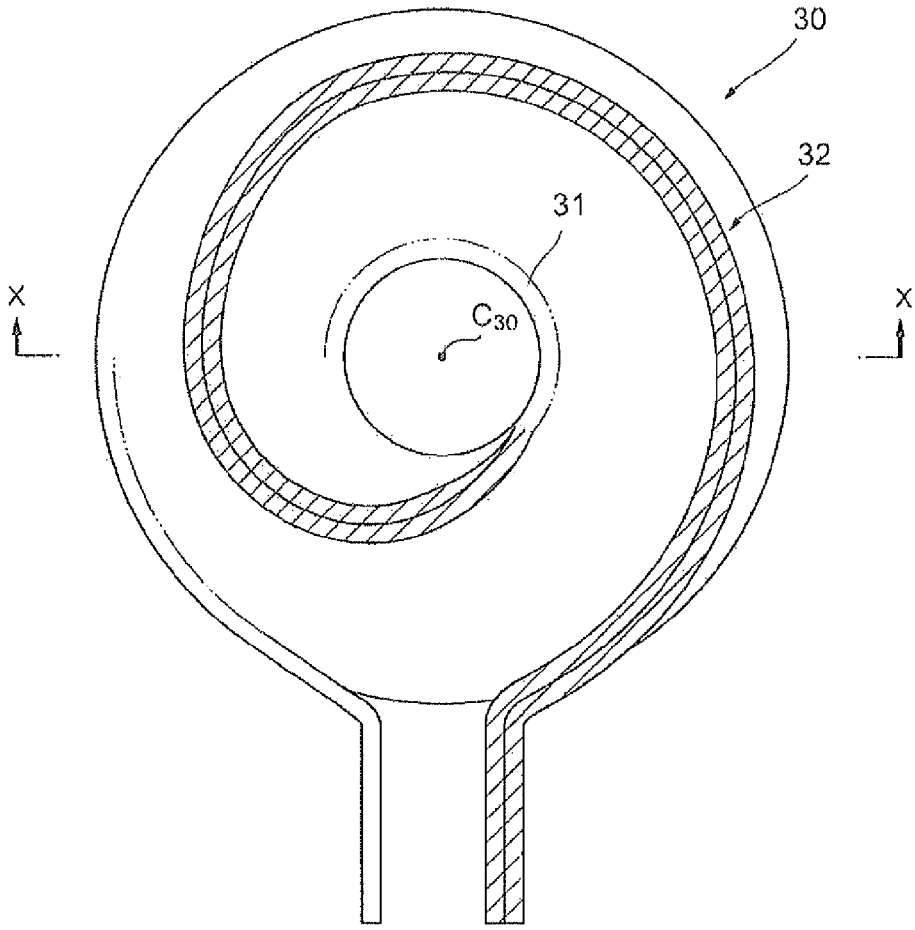
FIG. 4A is a plan view.
Figure 4B:
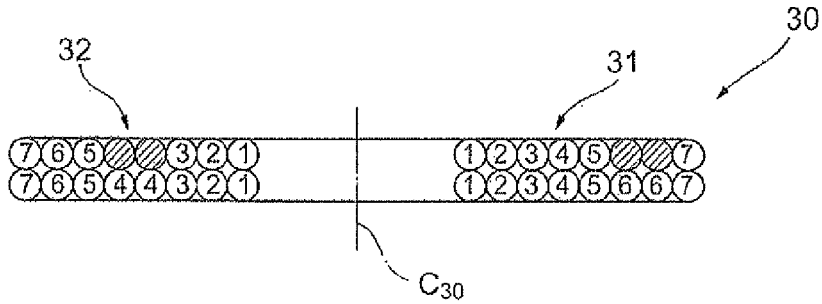
FIG. 4B is a cross-sectional view along the X-X line in FIG. 4A.

The wound state (naruto spiral winding) of the first winding 10A will be explained below in greater details with reference to FIGS. 4 to 11. FIG. 4 shows schematically a winding wire 30 wound similarly to the first winding 10A. FIG. 5 shows schematically a state in which the number of turns of the winding 30 is reduced by half to explain the wound state of the winding 30 in greater details. The numerical values included in the cross section in FIGS. 4B, 5B, and 5C show the turn number of the winding (it is the same in FIGS. 6 to 8).

The winding 30 shown in FIGS. 4 and 5 is constituted by a plurality of wires including two wires (round cross section). One side 31 of the winding wire (only the innermost circumferential portion and outermost circumferential portion are shown) is tightly wound (about 7 turns) in the counterclockwise direction, as shown in the FIG. 1, from the inner circumferential side to the outer circumferential side, and the other side 32 (hatched winding wire) of the winding is drawn forth from the inner circumferential side to the outer circumferential side, while being wound (about 1 turn) so as to form a smooth spiral curve in the clockwise direction as shown in the FIG. 1, while crossing the one side 31 of the winding wire. The thickness in the crossing portions of the one side 31 of the winding wire and the other side 32 of the winding wire in the direction of the winding shaft axis $C_{30}$ is equal to the thickness of the other portion.

Figure 5A:
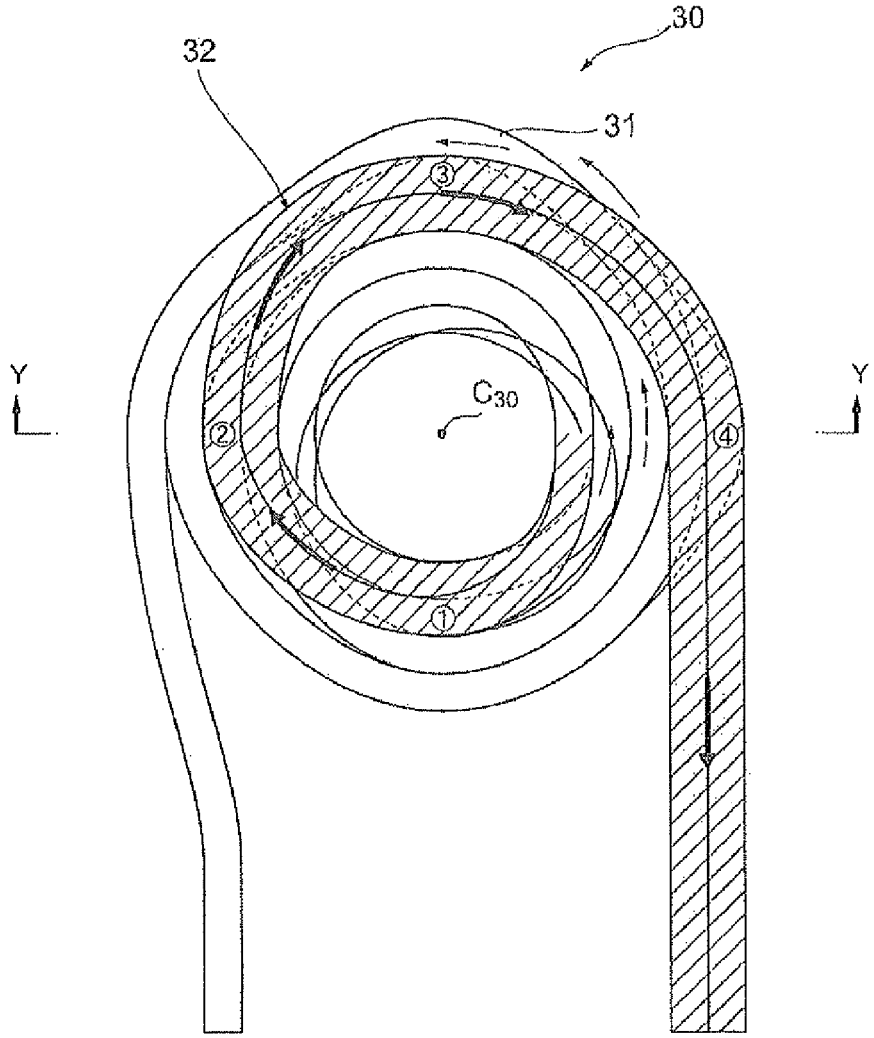
FIG. 5A is a plan view.
Figure 5B:
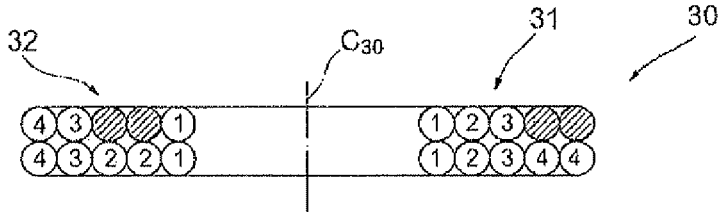
FIG. 5B is a cross-sectional view along the Y-Y line in FIG. 5A.
Figure 5C:
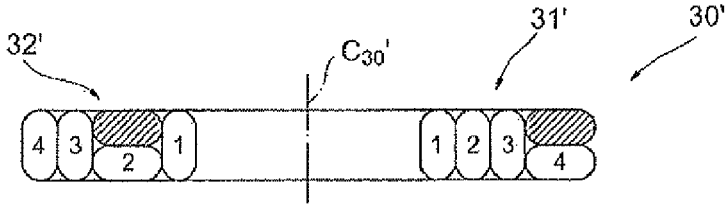
FIG. 5C is a cross-sectional view relating to the case in which the winding wires are single winding wires.

Thus, as shown in FIG. 4B and FIGS. 5A and 5B, the other side 32 of the winding wire is wound in a state in which two wires are arranged side by side in the diametrical direction. By contrast, the one side 31 of the winding wire is wound in a state in which the two wires are superimposed in the direction of the winding shaft axis $C_{30}$ in a portion where the one side 31 does not cross the other side 32 of the winding wire, whereas in the portions in which the one side 31 crosses the other side 32 of the winding wire (positions indicated by numbers 1 to 4 in the circles in FIG. 5A), the two wires are wound in a state of being arranged side by side in the diametrical direction. As a result, a configuration is obtained in which the thickness in the crossing portions of the one side 31 of the winding wire and the other side 32 of the winding wire in the winding shaft axis $C_{30}$ is equal to the thickness in other portions. The above-described wound state of the first winding 10A is similar to the wound state of the winding 30 explained herein.

In the position with number 1 in the circle in FIG. 5A, the first turn of the one side 31 of the winding wire crosses the other side 32 of the winding wire. In the position with number 2 in the circle, the second turn of the one side 31 of the winding wire crosses the other side 32 of the winding wire. In the position with number 3 in the circle, the third turn of the one side 31 of the winding wire crosses the other side 32 of the winding wire. In the position with number 4 in the circle, the fourth turn of the one side 31 of the winding wire crosses the other side 32 of the winding wire.

Figure 9:
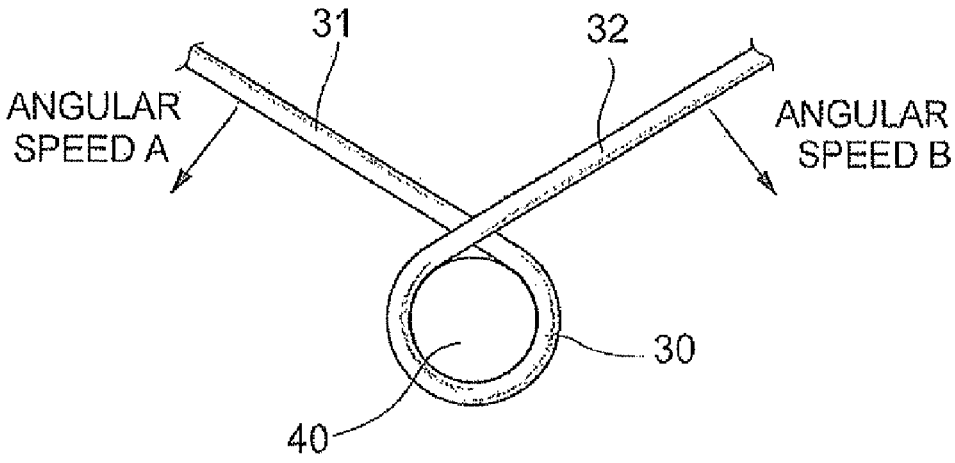
FIG. 9 is a schematic view illustrating a method for winding the winding wires.

The wound state of the winding 30 such as described hereinabove is formed by the winding method such as illustrated by FIG. 9. Thus, as shown in FIG. 9, the one side 31 of the winding wire and the other side 32 of the winding wire are wound in the mutually opposite directions around a winding shaft 40 of a winding machine. In this case, the winding is performed with settings such that an angular speed A of the one side 31 of the winding wire and the angular speed B of the other side 32 of the winding wire differ from one another, while the thickness in the direction of the winding shaft 40 (direction perpendicular to the sheet surface) is controlled by a frame (not shown in the figure) of the winding machine to the thickness of two wires. As a result, in the crossing portions of the one side 31 of the winding wire and the other side 32 of the winding wire, since the thickness is controlled by the winding frame (not shown in the figure), the two wires of the one side 31 of the winding wire and the two wires of the other side 32 of the winding wire are disposed in a state of being arranged in the diametrical direction. Thus, in the one side 31 of the winding wire, an aspect ratio of the winding wire cross section (ratio of the width in the diametrical direction and the width in the direction of the winding shaft axis) in the crossing portions with the other side 32 of the winding wire is different from that in the non-crossing portions. The air-core winding 30 such as described hereinabove is then formed by performing the fusing treatment after the winding has been completed and removing the winding from the winding shaft 40.

Figure 10:
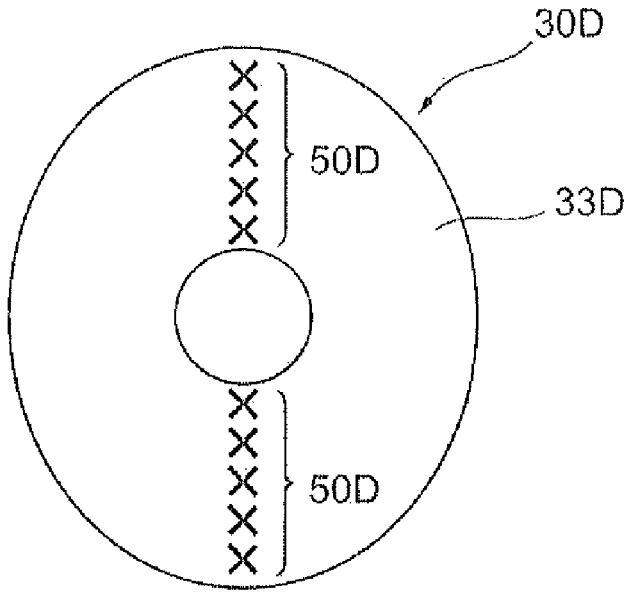
FIG. 10 is a schematic view illustrating a state in which the crossing portions of the one side of the winding wire and the other side of the winding wire are arranged linearly in the diametrical direction.

In such a winding method, when the aforementioned two angular speeds of winding are set to be equal to one another, a winding 30D of elliptical shape such as shown in FIG. 10 is formed. Thus, where the two angular speeds of winding are equal to each other, crossing portions 50D (marked by the x symbol in the figure) of the one side of the winding wire and the other side of the winding wire are arranged linearly in the diametrical direction. The two wires are arranged side by side in the diametrical direction in each crossing portion 50D. Therefore, in this portion, the winding wire protrudes to the outer circumferential side by one wire and since the protrusion amounts are superimposed in the diametrical direction, an end surface 33D of the coil 10A assumes an elliptical shape. This winding state is different from the above-described naruto spiral winding and is rather closer to the conventional α winding method. Therefore, in the present description, such winding is handled as a kind of α winding method. However, in such winding state, the winding is also performed such that the aspect ratio of the winding wire cross section in the crossing portions of the one side of the winding wire and the other side of the winding wire differs from the aspect ratio of the winding wire cross section in the non-crossing portions. As a result, the feature of the thickness of the crossing portions being equal to that of other portions is similar to that of the naruto spiral winding and such winding can be used as an alternative mode of naruto spiral winding.

Figure 11:
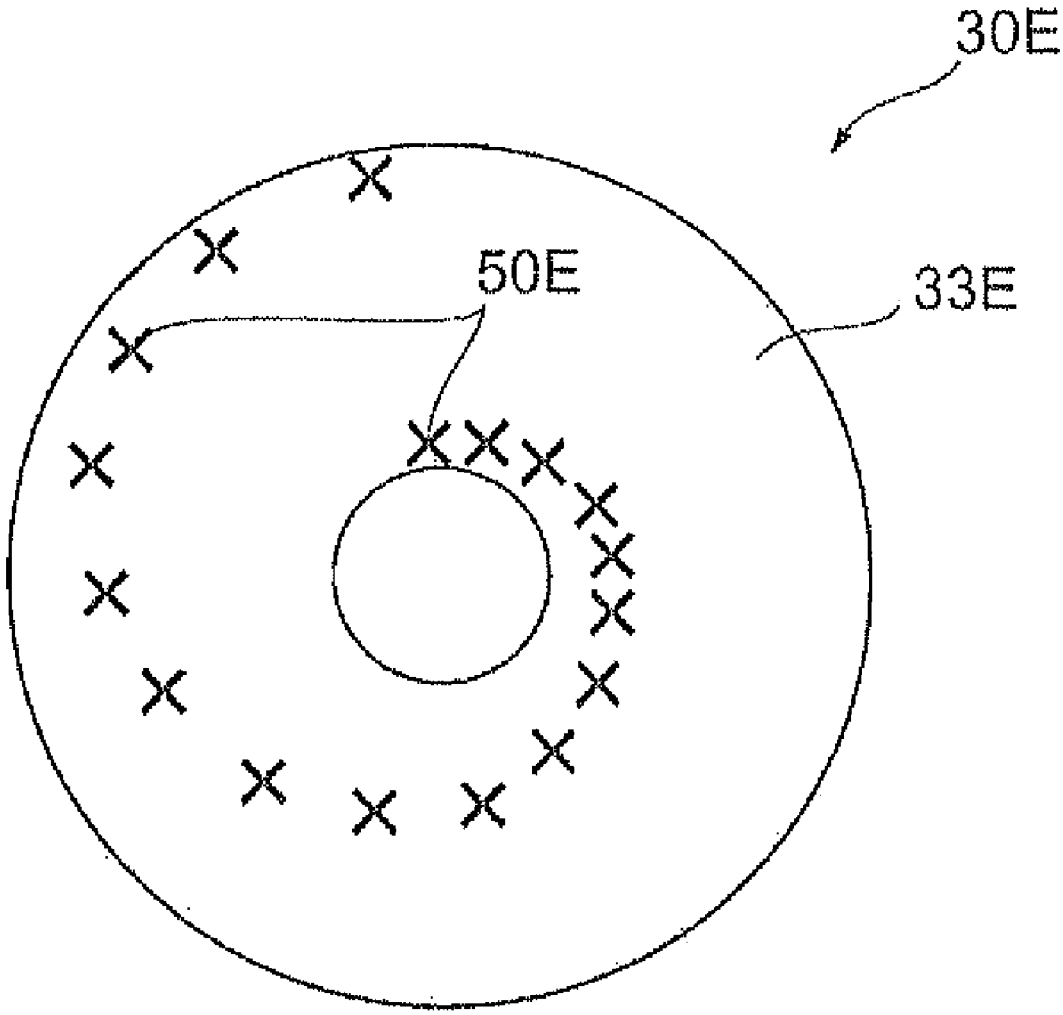
FIG. 11 is a schematic view illustrating a state in which the one side of the winding wire and the other side of the winding wire are arranged so as to shift in the circumferential direction towards the outer circumferential side.

When the two aforementioned angular speeds of winding are set to be different from one another, as shown in FIG. 11, a naruto spiral winding state is assumed in which crossing portions 50E of the one side of the winding wire and the other side of the winding wire shift in the circumferential direction towards the outer circumferential side and a winding 30E is formed with an end surface 33E having a shape close to a perfect circle. The winding 30 and the first winding 10A as described above are wires of this naruto spiral winding type.

FIGS. 4 and 5 illustrate the case in which the winding 30 is constituted by a plurality of wires including two wires, but a similar wound state can be also formed when the winding 30 is constituted by a plurality of wires including three or more wires and when the winding 30 is constituted by a single wire, and all of the below-described embodiments can be applied to the aforementioned first winding 10A.

FIG. 5C shows a winding 30' constituted by rectangular wires with a cross section aspect ratio of 2:1. In this winding 30', the winding is performed in a state in which the other side 32' of the winding wire is laid transversely (a state in which the longer side is arranged in the diametrical direction), whereas the one side 31' of the winding wire is wound in a state of being raised vertically in a portion that does not cross the other side 32' of the winding wire (a state in which the longer side is arranged in the direction of the winding shaft axis $C_{30'}$) and also in a state of being laid transversely in a portion that crosses the other side 32' of the winding wire. In this case, the thickness in the direction of the winding shaft axis $C_{30'}$ in the crossing portions of the one side 31' of the winding wire and the other side 32' of the winding wire is also equal to the thickness of other portions.

Figure 6:
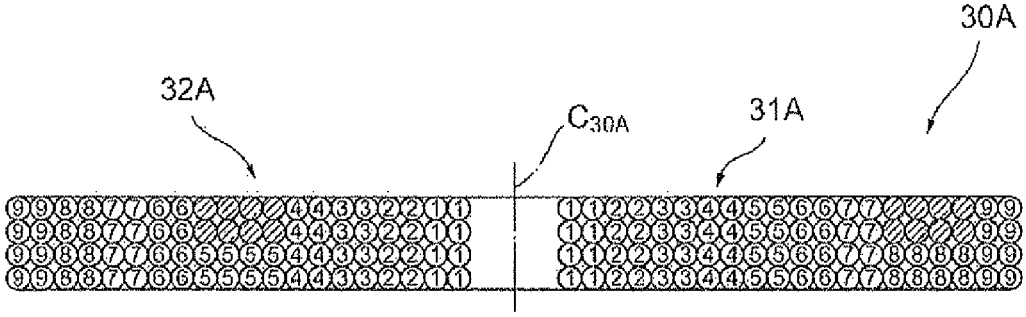
FIG. 6 is a cross-sectional view illustrating another mode of a winding state of the winding wires.

FIG. 6 shows a winding 30A constituted by a plurality of wires including eight wires. In this winding 30A, the eight wires of the other side 32A of the winding wire are wound in four rows in the diametrical direction and in two rows in the direction of the winding shaft axis $C_{30A}$, whereas the one side 31A of the winding wire is wound in a state such that in the portion in which the one side 31A does not cross the other side 32A of the winding wire, the eight wires are wound in two rows in the diametrical direction and four rows in the direction of the winding shaft axis $C_{30A}$, and in the portion in which the one side 31A crosses the other side 32A of the winding wire, the eight wires are wound in four rows in the diametrical direction and two rows in the direction of the winding shaft axis $C_{30A}$. In this case, the thickness in the direction of the winding shaft axis $C_{30A}$ in the crossing portions of the one side 31A of the winding wire and the other side 32A of the winding wire is also equal to the thickness of other portions.

Figure 7:
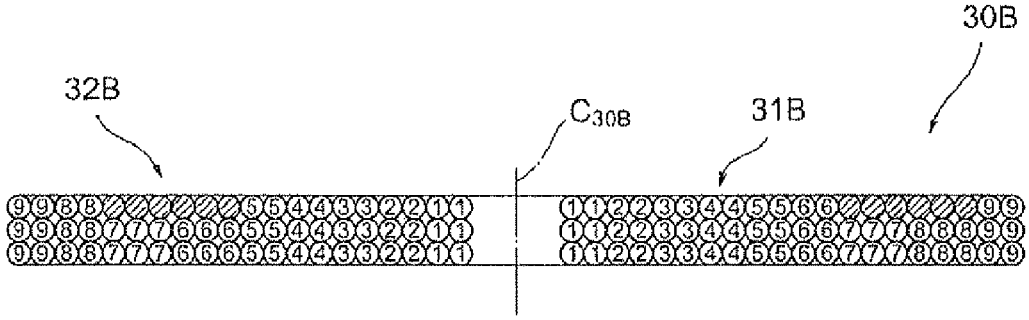
FIG. 7 is a cross-sectional view illustrating yet another mode of a winding state of the winding wires.

FIG. 7 shows a winding 30B constituted by a plurality of wires including six wires. In this winding 30B, the six wires of the other side 32B of the winding wire are wound in six rows in the diametrical direction and one row in the direction of the winding shaft axis $C_{30B}$, whereas the one side 3113 of the winding wire is wound in a state such that in the portion in which the one side 31B does not cross the other side 32B of the winding wire, the six wires are wound in two rows in the diametrical direction and three rows in the direction of the winding shaft axis $C_{30B}$, and in the portion in which the one side 31B crosses the other side 32B of the winding wire, the six wires are wound in three rows in the diametrical direction and two rows in the direction of the winding shaft axis $C_{30B}$. In this case, the thickness in the direction of the winding shaft axis $C_{30B}$ in the crossing portions of the one side 31B of the winding wire and the other side 32B of the winding wire is also equal to the thickness of other portions.

Figure 8:
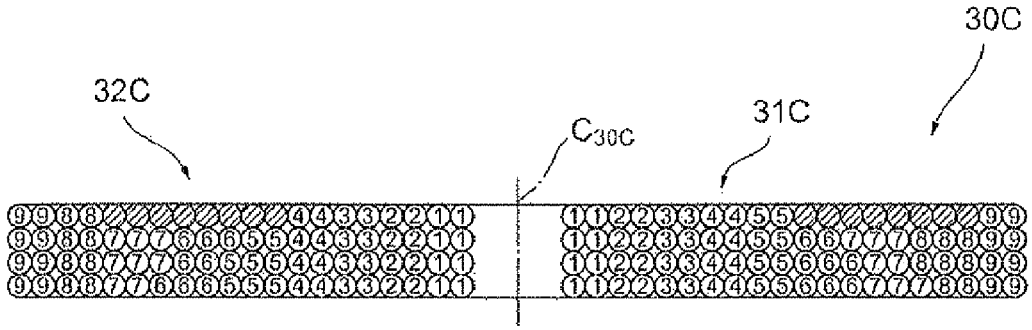
FIG. 8 is a cross-sectional view illustrating still another mode of a winding state of the winding wires.

FIG. 8 shows a winding 30C constituted by a plurality of wires including eight wires. In this winding 30C, the eight wires of the other side 32C of the winding wire are wound in eight rows in the diametrical direction and one row in the direction of the winding shaft axis $C_{30C}$, whereas the one side 31C of the winding wire is wound in a state such that in the portion in which the one side 31C does not cross the other side 32C of the winding wire, the eight wires are wound in two rows in the diametrical direction and four rows in the direction of the winding shaft axis $C_{30C}$, and in the portion in which the one side 31C crosses the other side 32C of the winding wire, the eight wires are wound in a state of being successively embedded from the inner circumferential side into spaces formed on the lower side, as shown in the FIG. 8, of the eight wires of the one side 31C of the winding wire. In this case, the thickness in the direction of the winding shaft axis $C_{30C}$ in the crossing portions of the one side 31C of the winding wire and the other side 32C of the winding wire is also equal to the thickness of other portions.

With the coil 1A of the first embodiment that has the above-described configuration, since the coil includes the first winding 10A wound about the winding shaft axis $C_{1A}$ and the second winding 20A wound coaxially on the outer circumferential portion of the first winding 10A, it is possible to switch between a mode in which only the first winding 10A is used as a small-diameter coil and a mode in which the first winding 10A and the second winding 20A are used together as one large-diameter coil (the end portion 11Aa of the one side 11A of the winding wire in the first winding 10A and the end portion 22Aa of the other side 22A of the winding wire in the second winding 20A are electrically connected), that is, to change the diameter of the region used as the coil 1A. Furthermore, since the second winding 20A is wound so as to be in intimate contact with the outer circumferential portion of the first winding 10A, no useless space appears between the first winding 10A and the second winding 20A, and therefore the size of one coil 1A in the diametrical direction can be reduced. Other embodiments are also possible. For example, it is possible to switch between the case in which only the first winding 10A is used as the coil 1A and the case in which only the second winding 20A is used as the coil 1A.

Further, the first winding 10A is configured such that the one side 11A of the winding wire is wound from the inner circumferential side to the outer circumferential side, the other side 12A of the winding wire is drawn forth from the inner circumferential side to the outer circumferential side, while crossing the one side 11A of the winding wire, and the thickness in the direction of the winding shaft axis $C_{1A}$ in the crossing portions of the one side 11A of the winding wire and the other side 12A of the winding wire is equal to the thickness of other portions. Therefore, in the winding region of the first winding 10A, the uniformity of thickness in the direction of the winding shaft axis $C_{1A}$ can be achieved and thickness can be reduced.

When the one side 11A of the winding wire and the other side 12A of the winding wire of the first winding 10A and the other side 22A of the winding wire of the second winding 20A are drawn forth to the outer circumferential side of the second winding 20A, it is preferred that the windings 10A, 20A are laid transversely and dragged in this state over the end surface of the second winding 20A because the thickness of the drawing line portions of the windings 10A, 20A is suppressed.

⟨Second Embodiment⟩

Figure 2:
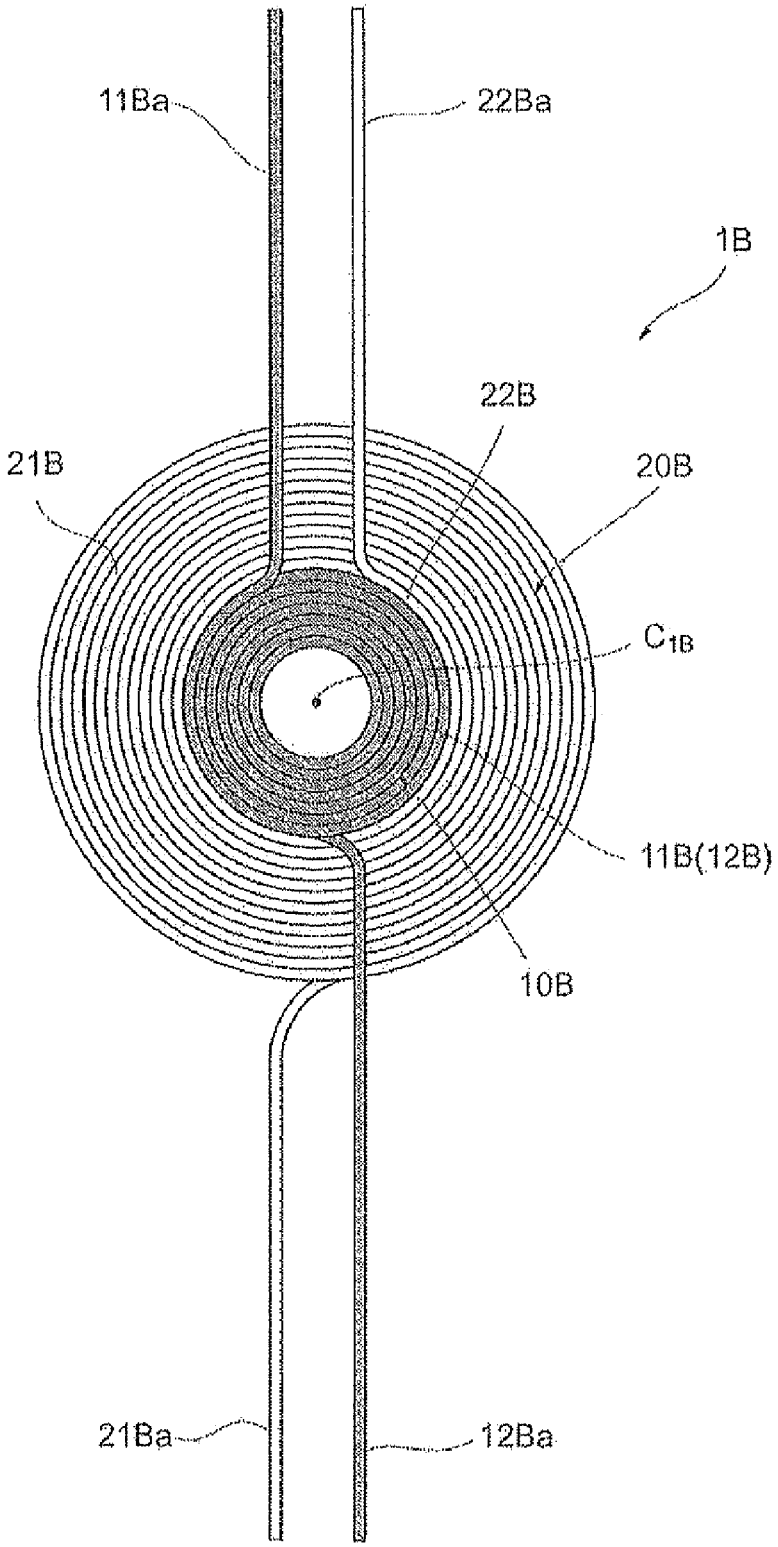
FIG. 2 is a schematic view illustrating the configuration of the coil according to the second embodiment.

Similarly to the above-described coil 1A of the first embodiment, a coil 1B of the second embodiment illustrated by FIG. 2 is also a thin-type air-core coil that can be advantageously used for contactless power transmission and includes a first winding 10B (in the present embodiment, this winding is constituted by a plurality of wires) wound about the winding shaft axis $C_{1B}$ and a second winding 20B (in the present embodiment, this winding is constituted by a plurality of wires) wound coaxially with the first winding 10B so as to be in intimate contact with the outer circumferential portion of the first winding 10B.

The above-mentioned first winding 1013 is wound by the cc winding method. Thus, one side 11B of the winding wire is tightly wound in the clockwise direction, as shown in the FIG. 2, from the inner circumferential side to the outer circumferential side of the first winding 10B, and the other side 1211 of the winding wire is tightly wound (at the same angular speed as the one side 11B of the winding wire) in the counterclockwise direction, as shown in the FIG. 2, from the inner circumferential side to the outer circumferential side. As a result, the one side 11B of the winding wire and the other side 12B of the winding wire are drawn forth together to the outer circumferential side and the thickness in the direction of the winding shaft axis $C_{1B}$ in the crossing portions of the one side 11B of the winding wire and the other side 12B of the winding wire is equal to the thickness of other portions. Further, an end portion 11Ba of the one side 11B of the winding wire and an end portion 12Ba of the other side 123 of the winding wire are drawn forth (the end portion 11Ba is drawn upward as shown in the figure, and the end portion 12Ba is drawn downward as shown in the figure) from the outer circumferential side of the first winding 10B to the outer circumferential side of the second winding 20B by dragging in the diametrical direction over the end surface of the second winding 20B. The α winding method as referred to herein may be the typical conventional α winding method (the aspect ratio of the winding wire cross section in the crossing portions of the one side of the winding wire and the other side of the winding wire is equal to the aspect ratio of the winding wire cross section in the non-crossing portions) or may be the α winding method of the type explained with reference to FIG. 10.

The second winding 203 is wound by the usual winding method. Thus, one side 21B of the winding wire is tightly wound in the clockwise direction, as shown in the FIG. 2, from the inner circumferential side to the outer circumferential side of the second winding 20B (from the outer circumferential side of the first winding 10B to the outer circumferential side of the second winding 20B), and then the end portion 21Ba of the one side 21B of the winding wire is pulled out downward, as shown in the FIG. 2, from the outer circumferential side of the second winding 20B. Further, the other side 22B of the winding wire is wound through about ¼ of a turn in the counterclockwise direction, as shown in the FIG. 2, on the inner circumferential side of the second winding 20B and then drawn forth from the inner circumferential side of the second winding 20B to the outer circumferential side of the second winding 20B by dragging over the end surface of the second winding 20B in the diametrical direction. The end portion 22Ba is then pulled out upward as shown in the FIG. 2.

The coil 1B of the second embodiment of the above-described configuration makes it possible to obtain the effect similar to that of the coil 1A of the above-described first embodiment.

⟨Third Embodiment⟩

Figure 3:
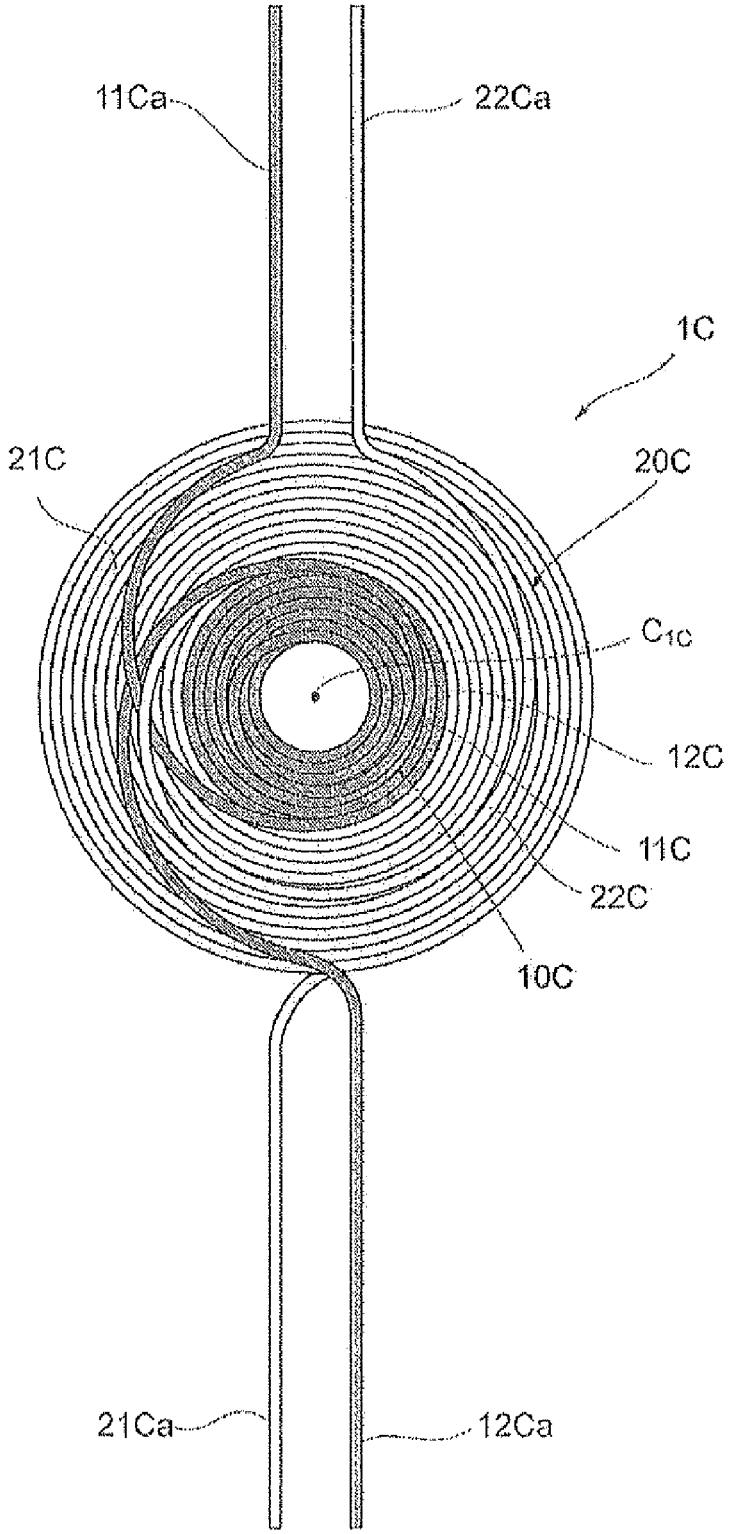
FIG. 3 is a schematic view illustrating the configuration of the coil according to the third embodiment.

Similarly to the above-described coil 1A of the first embodiment and coil 1B of the second embodiment, a coil 1C of the third embodiment illustrated by FIG. 3 is also a thin-type air-core coil that can be advantageously used for contactless power transmission and includes a first winding 10C (in the present embodiment, this winding is constituted by a plurality of wires) wound about the winding shaft axis $C_{1C}$ and a second winding 20C (in the present embodiment, this winding is constituted by a plurality of wires) wound coaxially with the first winding 10C so as to be in intimate contact with the outer circumferential portion of the first winding 10C.

The first winding 10C is wound by the naruto spiral winding method. Thus, one side 11C of the winding wire is tightly wound in the clockwise direction, as shown in the FIG. 3, from the inner circumferential side to the outer circumferential side of the first winding 10C, and the other side 12C of the winding wire is drawn forth from the inner circumferential side to the outer circumferential side of the first winding 10C, while being wound (about 1 turn) so as to form a smooth spiral curve in the counterclockwise direction as shown in the FIG. 3 while crossing the one side 11C of the winding wire, and the thickness in the direction of the winding shaft axis $C_{1C}$ in the crossing portions of the one side 11C of the winding wire and the other side 12C of the winding wire is equal to the thickness in other portions.

The second winding 20C is also wound by the naruto spiral winding method. Thus, one side 21C of the winding wire is tightly wound in the clockwise direction, as shown in the FIG. 3, from the inner circumferential side to the outer circumferential side of the second winding 20C (from the outer circumferential side of the first winding 10C to the outer circumferential side of the second winding 20C), and the other side 22C of the winding wire is drawn forth from the inner circumferential side to the outer circumferential side of the second winding 20C, while being wound (about 1 turn) so as to form a smooth spiral curve in the counterclockwise direction as shown in the FIG. 3 while crossing the one side 21C of the winding wire, and the thickness in the direction of the winding shaft axis $C_{1C}$ in the crossing portions of the one side 21C of the winding wire and the other side 22C of the winding wire is equal to the thickness in other portions.

In the third embodiment, naruto spiral winding is used when the one side 11C of the winding wire and the other side 12C of the winding wire in the first winding 10C are drawn forth to the outer circumferential portion of the second winding 20C. Thus, one side 11C of the winding wire and the other side 12C of the winding wire in the first winding 10C form respective spiral curves (the one side 11C rotates clockwise and the other side 12C rotates counterclockwise as shown in the figure), and are drawn forth to the outer circumferential side of the second winding 20C, while crossing each other or the one side 21C of the winding wire or the other side 22C of the winding wire in the second winding 20C, and the second winding 20C is configured such that the thickness in the direction of the winding shaft axis $C_{1C}$ in each crossing portion of the one side 11C of the winding wire and the other side 12C of the winding wire in the first winding 10C and of the second winding 20C is equal to the thickness of other portions.

The effect obtained with the coil 1C according to the third embodiment of such a configuration is similar to that obtained with the coil 1A according to the above-described first embodiment, and in the winding region of the second winding 20C, it is also possible to achieve the uniformity of thickness in the direction of the winding shaft axis $C_{1C}$ and the thickness can be also reduced.

The embodiments of the present invention are described above, but the present invention is not limited to the above-described embodiments and these embodiments can be changed in a variety of ways.

For example, in the above-described embodiments, the case is explained by way of example in which both the first winding and the second winding are constituted by a plurality of wires that can be separated at the winding stage, but a single wire or twisted wire can be also used for the second winding 20A in the first embodiment, first winding 10B and second winding 20B in the second embodiment, and second winding 20C in the third embodiment.

Further, the number of wires and the arrangement state of wires during winding in the case in which a plurality of wires are used are not limited to those in the above-described embodiments and can be variously changed.

Figure 12:
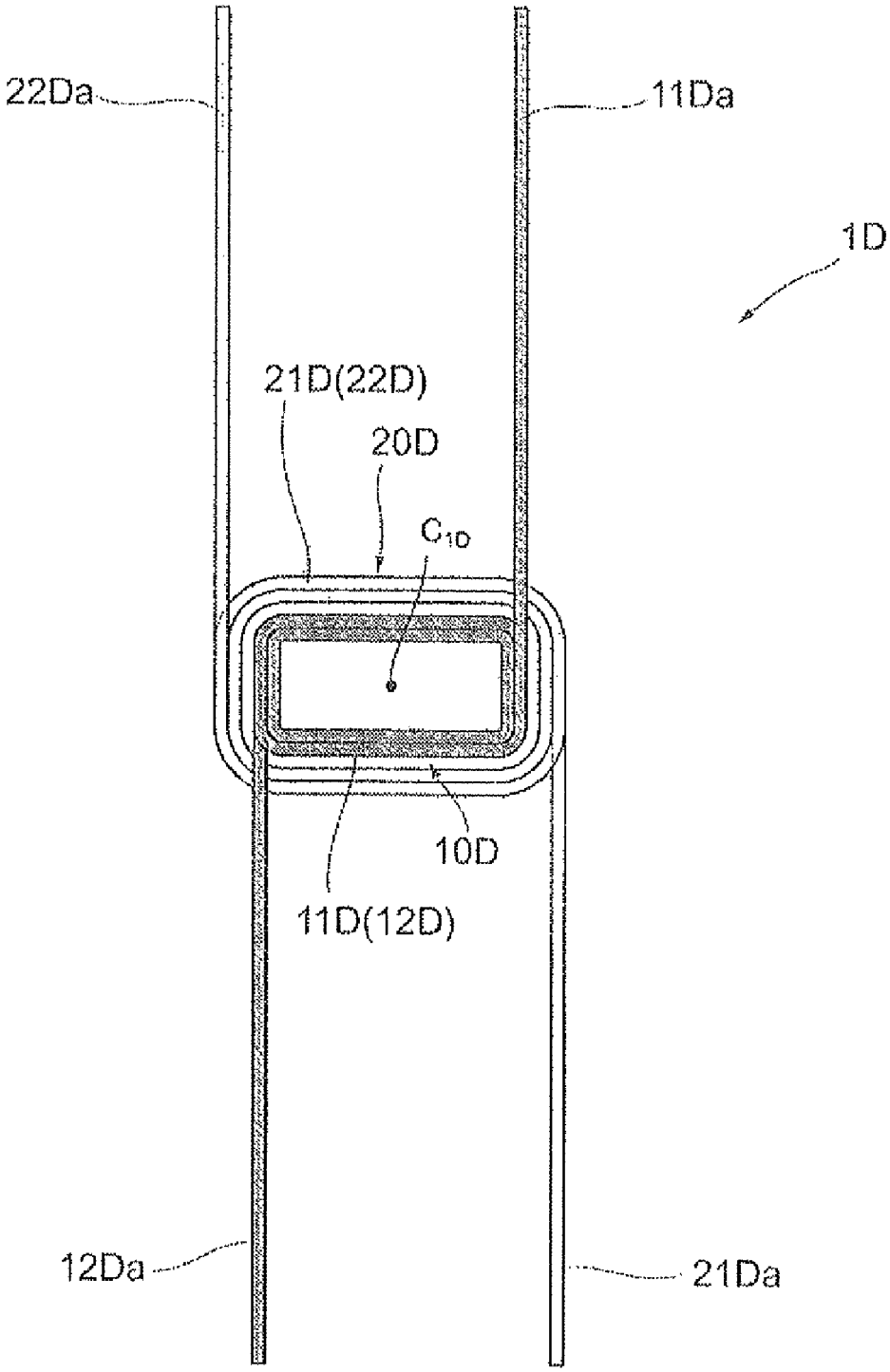
FIG. 12 is a schematic view illustrating a state in which the outer contour shape of the coil and the shape of each corner of an air-core portion are rounded rectangular shapes.
Figure 13:
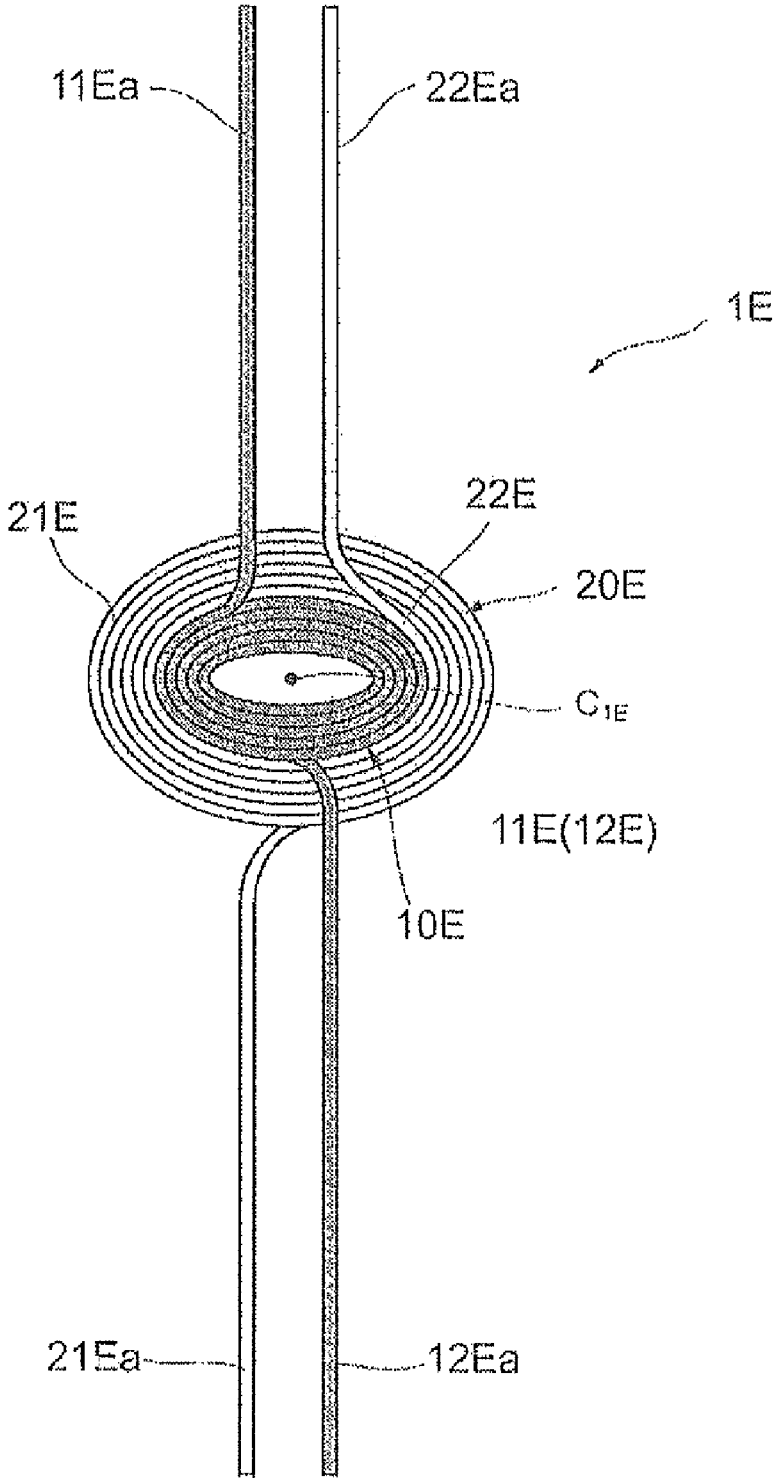
FIG. 13 is a schematic view illustrating a state in which the outer contour shape of the coil and the shape of an air-core portion are elliptical shapes.

Further, in the above-described embodiments, the outer contour of each coil and the air-core portions are of circular shape, but rounded rectangular or elliptical shapes can be also used (examples of such shapes are shown in FIGS. 12 and 13). In a coil 1D shown in FIG. 12, the outer contour and air-core portion both have rounded rectangular shapes, a first winding 10D is wound by the α winding method, and a second winding 20D is wound by the usual winding method. In a coil 1E shown in FIG. 13, the outer contour and air-core portion both have elliptical shapes, and both a first winding 10E and a second winding 20D are wound by the α winding method. The naruto spiral winding method can be also used for the first windings 10D, 10E and second windings 20D, 20E.

The coil in accordance with the present invention is not limited to applications for a transmitting or receiving side for contactless power transmission and can be also used for a transformer in which the first winding wire is provided as a primary winding wire and the second winding wire is provided as a secondary winding wire (or vice versa).

In the above-described embodiments, only the second winding wire is wound about the outer circumferential portion of the first winding, but the region used as a coil can be divided in a large number of stages. For example, a third winding wire can be wound on the outer circumferential portion of the second winding, a fourth winding wire can be wound on the outer circumferential portion of the third winding, and so on.

The present invention can be applied not only to an air-core coil, but also to a coil wound on a bobbin or core.

What is claimed is:

1. A coil comprising:

a first winding which is composed of a single wire or a plurality of wires, and is wound about a winding shaft axis; and a second winding which is composed of a single wire or a plurality of wires, and which is wound coaxially with the first winding so as to be in intimate contact with an outer circumferential portion of the first winding, wherein at least in the first winding among the first winding and the second winding, one side of a winding wire is wound from an inner circumferential side to an outer circumferential side, the other side of the winding wire is drawn forth from the inner circumferential side to the outer circumferential side, while crossing the one side of the winding wire, and a thickness in crossing portions of the one side of the winding wire and the other side of the winding wire in a direction of the winding shaft axis is equal to a thickness in other portions.

2. The coil according to claim 1, wherein the other side of the winding wire is drawn forth to the outer circumferential side so as to form a spiral curve so that the crossing portions of the one side of the winding wire and the other side of the winding wire shift in a circumferential direction towards the outer circumferential side.

3. The coil according to claim 2, wherein the one side of the winding wire and the other side of the winding wire in the first winding are drawn forth to the outer circumferential side of the second winding so as to form respective spiral curves, while crossing the second winding, and in the second winding, a thickness in a direction of the winding shaft axis in each of the crossing portions of the one side of the winding wire in the first winding, the other side of the winding wire in the first winding, and the second winding is equal to a thickness in other portions.

4. The coil according to claim 1, wherein the other side of the winding wire in the first winding is wound in a state in which two wires are arranged side by side in a diametrical direction, while at portions where the one side of the winding wire and the other side of the winding wire do not cross, the one side of the winding wire in the first winding is wound in a state in which the two wires are piled up in the direction of the winding shaft axis, and at portions where the one side of the winding wire and the other side of the winding wire cross, the one side of the winding wire in the first winding is wound in a state in which the two wires are arranged side by side in the diametrical direction.

5. The coil according to claim 1, wherein the coil is used for contactless power transmission.

6. The coil according to claim 1, wherein at least either one of the first winding and the second winding is composed of a plurality of wires and is also composed of a self-fusing wire.

7. The coil according to claim 1, wherein the coil is composed as an air-core coil.

8. The coil according to claim 1, wherein an outer contour shape and a shape of each corner of an air-core portion of an air-core coil are rounded rectangular shapes.

9. The coil according to claim 1, wherein an outer contour shape and a shape of an air-core portion of an air-core coil are elliptical shapes.

* * * * *